United States Patent [19]

Dan et al.

[11] Patent Number: 4,618,557

[45] Date of Patent: Oct. 21, 1986

[54] LIQUID DEVELOPER FOR ELECTROSTATIC PHOTOGRAPHY

[75] Inventors: Shigeyuki Dan; Kazuo Ishii; Eiichi Kato; Hidefumi Sera, all of Kanagawa, Japan

[73] Assignee: Fuji Photo Film Co., Ltd., Kanagawa, Japan

[21] Appl. No.: 763,112

[22] Filed: Aug. 7, 1985

[30] Foreign Application Priority Data

Aug. 7, 1984 [JP] Japan ..... 59-165088

[51] Int. Cl.[4] ..... G03G 9/12

[52] U.S. Cl. ..... 430/114; 430/115; 430/137

[58] Field of Search ..... 430/114, 115, 137

[56] References Cited

U.S. PATENT DOCUMENTS 3,990,980 11/1976 Kosel ..... 430/113

4,306,009 12/1981 Veillette et al. ..... 430/115

*Primary Examiner*—John D. Welsh

*Attorney, Agent, or Firm*—Sughrue, Mion, Zinn, Macpeak, and Seas

[57] ABSTRACT

An liquid developer for electrostatic photography is described, comprising a carrier liquid having an electric resistance of at least $10^9$ Ω·cm and a dielectric constant of not more than 3.5, and a resin dispersed therein, said resin being obtained by polymerizing a monomer, which is soluble in said carrier liquid but becomes insoluble upon being polymerized, in the presence of at least one kind of a soluble dispersion stabilizing resin, said soluble dispersion stabilizing resin being a copolymer containing at least recurring units represented by following formulae (IIIa) and (IIIb) obtained by applying a reaction for introducing an unsaturated bond into a copolymer obtained by polymerizing a monomer represented by formula (I) and a monomer represented by formula (III)

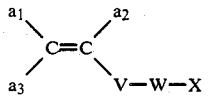

(I)

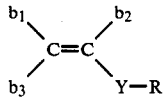

(II)

-continued

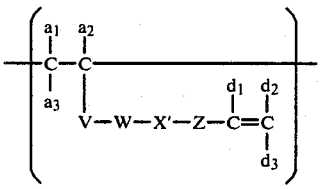

(IIIa)

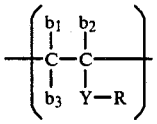

(IIIb)

wherein in formula (I), V represents —O—, —S—, —CO—, —$CO_2$—, —$SO_2$—, —OCO—, —CONH—, —CONR′— (wherein R′ represents a hydrocarbon group), —NHCO—, $NHCO_2$—, or —NHCONH—; X represents —$CO_2H$, —COCl, —OH, —SH, —$NH_2$, —NCO, or —$SO_2CH_2CH_2Cl$; W represents a hydrocarbon group linking said atomic group V and said atomic group X directly or through a hetero atom, or W represents a chemical bond; and $a_1$, $a_2$, and $a_3$ each represents a hydrogen atom, a hydrocarbon group, a carboxy group, or a carboxy group through a hydrocarbon group;

in formula (II), Y represents —O—, —S—, —CO—, —$CO_2$—, —$SO_2$—, —OCO—, CONH—, —CONR-″— (wherein R″ represents a hydrocarbon group), —NHCO—, —$NHCO_2$—, or —NHCONH—; R represents a hydrocarbon group; and $b_1$, $b_2$, and $b_3$ each represents a hydrocarbon atom, a hydrocarbon group, a carboxy group, or a carboxy group through a hydrocarbon group;

in formula (IIIa), $a_1$, $a_2$, $a_3$, V, and W have the same meanings as defined for formula (I); X′ represents —$CO_2$—, —COS—, —SCO—, —CONH—, —OCO—, —NHCO—, —NHCONH—, —$SO_2$—, —O—, or —S—; Z represents a hydrocarbon group linking said atomic group X′ and unsaturated bond directly or through a hetero atom, or Z represents a chemical bond; the total number of atoms of the main chain portion of atomic group —V—W—X′—Z— must, however, be at least 9; and $d_1$, $d_2$, and $d_3$ each represents a hydrocarbon atom, a hydrocarbon group, a carboxy group, or a carboxy group through a hydrocarbon group; and in formula (IIIb), $b_1$, $b_2$, $b_3$, Y, and R have the same meanings as defined for formula (II).

10 Claims, No Drawings

LIQUID DEVELOPER FOR ELECTROSTATIC PHOTOGRAPHY

FIELD OF THE INVENTION

This invention relates to a liquid developer for electrostatic photography comprising at least a resin dispersed in a carrier liquid having an electric resistance of at least $10^9$ Ω·cm and a dielectric constant of not more than 3.5. More particularly, the invention relates to a liquid developer excellent in redispersibility, shelf life, stability, and fixability.

BACKGROUND OF THE INVENTION

An ordinary liquid developer for electrostatic photography is generally prepared by dispersing organic or inorganic pigments or dyes, such as carbon black, Nigrosine, Phthalocyanine Blue, etc., and a natural or synthetic resin such as an alkyd resin, an acrylic resin, rosin, a synthetic rubber, etc., in a high-insulating and low-dielectric constant liquid such as a petroleum aliphatic hydrocarbon and further adding thereto a polarity controlling agent such as a polymer containing a metal soap, lecithin, linseed oil, a higher fatty acid, vinyl-pyrrolidone, etc. In such a liquid developer, a resin is dispersed therein as insoluble latex particles having diameters of several μm to several hundred μm, and since, in a conventional liquid developer, the bonding between a soluble dispersion stabilizing resin or a polarity controlling agent and insoluble latex particles is insufficient, the soluble dispersion stabilizing resin and the polarity controlling agent are in a state of easily diffusible in the liquid. Accordingly, in such a conventional liquid developer, there is a disadvantage that the soluble dispersion stabilizing resin is released from the insoluble latex particles by the storage of the developer for a long period of time or by repeated use of the developer, the cause precipitation, aggregation, or accumulation of the latex particles, whereby the polarity of the liquid developer becomes obscure. Also, since the latex particles, once aggregated or accumulated, are difficult to disperse again, the particles stick to various portions of a developing devince to cause strains of images formed as well as problems of the developing device, such as clogging of a liquid supply pump, etc.

For eliminating these disadvantages, a means for chemically bonding the soluble dispersion stabilizing resin and the insoluble latex particles is disclosed in U.S. Pat. No. 3,990,980.

However, the improvement for the redispersibility, the shelf life, and stability of the liquid developer was insufficient, and the latex particles precipitated or accumulated at various portions of a developing device were solidified in film-form and were difficult to redisperse in the means disclosed in aforesaid U.S. Pat. No. 3,990,980. Also, the particles prepared by the above-described means have two or more peaks in the particle size distribution curve or a broad particle size distribution, and it was difficult to control the particle size of the particles. Thus, the liquid developer containing the particles was also poor in shelf life and stability.

SUMMARY OF THE INVENTION

An object of this invention, therefore, is to overcome the above-described difficulties in conventional liquid developers for electrostatic photography. That is, the object of this invention is to provide a liquid developer the redispersibility and stability of which are not deteriorated by the storage of the developer for a long period of time, nor by repeated use thereof.

Other object of this invention to provide a liquid developer which does not cause problems in a developing apparatus, such as clogging of liquid supply pumps, etc., or stain of images by the repeated use of the developer.

A further object of this invention is to provide a liquid developer which does not change polarity upon long storage or by repeated use thereof and always reproduces clear images.

Still another object of this invention is to provide a liquid developer having uniform particle size which provides excellent resolving power at fine line portions and dot portions.

According to the results of various investigations, it has been discovered that the above-described objects of this invention have been attained by the present invention as set forth below.

That is, according to this invention, there is provided a liquid developer for electrostatic photography comprising a carrier liquid having an electric resistance of at least $10^9$ Ω·cm and a dielectric constant of not more than 3.5, and a resin dispersed therein, said resin being obtained by polymerizing a monomer (A), which is soluble in the carrier liquid but becomes insoluble upon being polymerized, in the presence of at least one kind of a soluble dispersion stabilizing resin and said soluble dispersion stabilizing resin being a copolymer containing at least recurring units represented by formulae (IIIa) and (IIIb) obtained by further applying a reaction for introducing an unsaturated bond into a copolymer by polymerizing a monomer (B) represented by general formula (I) and a monomer (C) represented by general formula (II);

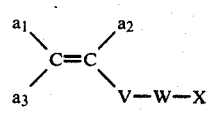

(I)

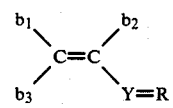

(II)

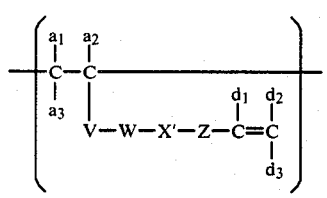

(IIIa)

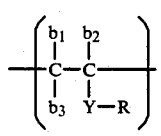

(IIIb)

In formula (I), V represents —O—, —S—, —CO—, —$CO_2$—, —$SO_2$—, —OCO—, —CONH—, —CONR' (wherein R' represents a hydrocarbon group, preferably $C_1$ to $C_6$), —NHCO—, —$NHCO_2$—, or —NHCONH—; X represents —$CO_2H$, —COCl, —OH, —SH, —$NH_2$, —NCO, or —$SO_2CH_2CH_2Cl$; W represents a hydrocarbon group linking the atomic group V and the atomic group X, which may be through a hetero atom, or W represents a chemical bond; and $a_1$, $a_2$, and $a_3$ (which may be the same or different) each represents a hydrogen atom, a hydrocarbon group (preferably $C_1$ to $C_4$), a carboxy group, or a carboxy group through a hydrocarbon group.

In formula (II), Y represents —O—, —S—, —CO—, —$CO_2$—, —$SO_2$—, —OCO—, —CONH—, —CONR"— (wherein R" represents a hydrocarbon group, preferably $C_1$ to $C_6$), —NHCO—, —$NHCO_2$—, or —NHCONH—; R represents a hydrocarbon group (preferably $C_1$ to $C_6$); and $b_1$, $b_2$, and $b_3$ (which may be the same or different) each represents a hydrogen atom, a hydrocarbon group (preferably $C_1$ to $C_4$), a carboxy group, or a carboxy group through a hydrocarbon group.

In formula (IIIa), $a_1$, $a_2$, $a_3$, V, and W have the same meanings as defined for formula (I); X' represents —$CO_2$—, —COS—, —SCO—, —CONH—, —OCO—, —NHCO—, —NHCONH—, —$SO_2$—, —O—, or —S—; Z represents a hydrocarbon group for linking the atomic group X' to an unsaturated bond, which may be through a hetero atom, or Z represents a chemical bond; the total number of atoms of the main chain moiety of the atomic group —V—W—X'—Z— must be at least 9; and $d_1$, $d_2$, and $d_3$ (which may be the same or different) each represents a hydrogen atom, a hydrocarbon group (preferably $C_1$ to $C_4$), a carboxy group, or a carboxy group through a hydrocarbon group.

In formula (IIIb), $b_1$, $b_2$, $b_3$, Y and R have the same meanings as defined for formula (II).

DESCRIPTION OF PREFERRED EMBODIMENTS

Preferred carrier liquids having an electric resistance of at least $10^9$ Ω·cm and a dielectric constant of not more than 3.5 for use in this invention include straight-chain or branched-chain aliphatic hydrocarbons and the halogen-substitution products thereof. Examples of these materials are octane, isooctane, decane, isodecane, decalin, nonane, dodecane, isododecane, Isopar E, Isopar G, Isopar H, Isopar L (Isopar is a trademark of Exxon Co.), Shellsol 70, Shellsol 71 (Shellsol is a trademark of Shell Oil Co.), AMSCO OMS, AMSCO 460 solvent (AMSCO is a trademark of Spirits Co.), etc., and they may be used solely or as a mixture of them.

The resin (i.e., insoluble latex particles) for use in this invention are prepared by a so-called dispersion polymerization method using the soluble dispersion stabilizing resin and in this case, a straight chain or branched aliphatic hydrocarbon, an alicyclic hydrocarbon, an aromatic hydrocarbon or the halogen-substitution products imiscible with the above-described carrier liquid can be used as a solvent for the polymerization. Examples of the solvent are octane, isooctane, decane, isodecane, decalin, nonane, dodecane, isododecane, Shellsol 70, Shellsol 71, AMSCO OMS, AMSCO 460 solvent. they may be used individually or as a mixture thereof.

For stably obtaining the insoluble latex particles in such a nonaqueous solvent, at least one kind of a copolymer containing repeating units represented by formula (IIIa) and (IIIb) described above is used. There is no particular restriction on the solvent which is used at the preparation of the aforesaid copolymer, but the solvent is preferably miscible with the solvent which is used for the subsequent dispersion polymerization process, since the copolymerization product can be used in the subsequent dispersion polymerization process without need of removing the solvent from the polymerization system. For example, straight chain or branched aliphatic hydrocarbons, alicyclic hydrocarbons, aromatic hydrocarbons, and the halogen-substituted products thereof can be used singly or as a mixture thereof.

As the monomer (B) represented by above-described formula (I), a monomer in which the atomic group X as a reactive moiety of a marcomolecular reaction for introducing an unsaturated bond is apart from a polymerization active unsaturated bond and which has a high activity is preferred. Examples of the monomer (B) are as follows.

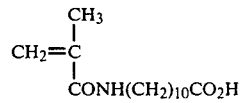
B-(1)

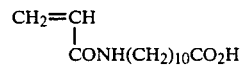
B-(2)

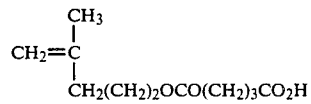
B-(3)

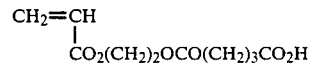
B-(4)

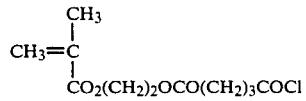
B-(5)

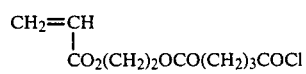
B-(6)

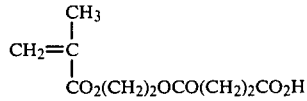
B-(7)

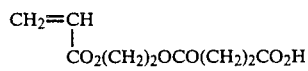
B-(8)

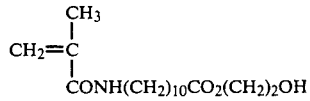
B-(9)

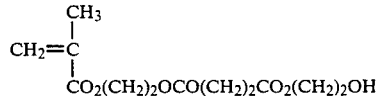
B-(10)

The chemical names of monomers B-(1) to B-(10) are as follows:

B-(1) 11-(Methacryloylamino)undecanoic acid
B-(2) 11-(Acryloyoamino)undecanoic acid
B-(3) 2-[(2-Methyl-1-oxo-2-propenyl)oxy]ethyl hydrogen glutarate
B-(4) 2-[(1-Oxo-2-propenyl)oxy]ethyl hydrogen glutarate
B-(5) 2-[(1-Oxo-4-chloroformylbutyl)oxy]ethyl methacrylate
B-(6) 2-[(1-Oxo-4-chloroformylbutyl)oxy]ethyl acrylate
B-(7) 2-[(2-Methyl-1-oxo-2-propenyl)oxy]ethyl hydrogen succinate B-(8) 2-[(1-Oxo-2-propenyl)oxy]ethyl hydrogen succinate B-(9) 2-Hydroxyethyl 11-(methacryloylamino)undecanate B-(10) 2-[(2-Methyl-1-oxy-2-propenyl)oxy]ethyl 2-hydroxyethyl succinate.

Also, the monomer (C) represented by above-described formula (II) is for rendering the resin soluble and it is preferred that the alkyl group R is in a state of easily miscible with the carrier liquid having an electric resistance of at least $10^9$ Ω·cm and a dielectric constant of not more than 3.5. Examples of the monomer (C) include alkyl esters of acrylic acid or methacrylic acid (the alkyl group includes, for example, an octyl group, a decyl group, a dodecyl group, a tetradecyl group, a hexadecyl group, an octadecyl group, a 2-ethylhexyl group, etc.,) and alkenyl esters of acrylic acid or methacrylic acid (the alkenyl group includes, for example, an octenyl group, a decenyl group, an octadecenyl group, an oleyl group, etc.,).

As a reaction reagent which is used for introducing an unsaturated bond by causing a reaction with the copolymer obtained by polymerizing monomer (B) and monomer (C) as described above, there are vinyl esters or allyl esters of aliphatic carboxylic acid (the alkyl group includes a methyl group, an ethyl group, a butyl group, a propyl group, an isopropyl group, etc.), unsaturated alcohols (e.g., allyl alcohol), unsaturated carboxylic acid esters having a hydroxy group, an amino group or a carboxy group at the alcohol moiety of the ester (e.g., hydroxyethyl acrylate, hydroxypropyl acrylate, etc.), unsaturated amines (e.g., allylamine), ethers having unsaturated bond (e.g., butylvinyl ether), unsaturated thiols, etc.

As the above-described monomer (A) for use in this invention, a monomer which is soluble in the above-described carrier liquid and nonaqueous solvent, but becomes insoluble therein by being polymerized. Examples of such a monomer are alkyl esters (the alkyl moiety having 1 to 3 carbon atoms) of unsaturated carboxylic acids such as acrylic acid, methacrylic acid, crotonic acid, itaconic acid, maleic acid, etc.; vinyl esters or allyl esters of aliphatic carboxylic acids having from 1 to 3 carbon atoms; unsaturated carboxylic acids such as acrylic acid, methacrylic acid, crotonic acid, maleic acid, itaconic acid, etc., and the anhydrides thereof; hydroxyethyl acrylate; hydroxyethyl methacrylate; N-vinylpyrrolidone; acrylonitrile; vinyl ether, etc. The preferred examples of the monomer (A) include a substance represented by the following formula (IV), itaconic anhydride, maleic anhydride, vinylpyrrolidone, and acrylonitrile;

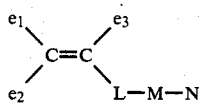

(IV)

In formula (IV), $e_1$, $e_2$ and $e_3$ (which may be the same or different) each represents a hydrogen atom, a hydrocarbon group having 1 to 4 carbon atoms, a carboxy group, or a carboxy group through a hydrocarbon group; L represents a hydrocarbon atom having 1 to 2 carbon atoms, or L represents a chemical bond; M represents $—CO_2—$, —OCO—, or —O—; and N represents a hydrogen atom, a hydrocarbon group having 1 to 3 carbon atoms, or a hydroxyl group through a hydrocarbon group.

The soluble copolymer resin having unsaturated bond, which is used in this invention, is prepared by using the above-described materials as follows.

Monomer (B) and monomer (C) are dissolved in the above-described solvent and the solution is heated for several hours at 50° C. to 200° C. in the presence of a polymerization initiator. Then, a polymerization inhibitor (preferably, 0.01 to 1 g per liter of the reaction mixture) and the above-described reactive reagent for introducing unsaturated bond are added to the reaction mixture, and after, if desired, further adding thereto a catalyst such as $Ti(OBu)_4.H_2SO_4$, $Hg(OAc)_2.Me_2NC_{12}H_{25}$, (wherein, Bu represents butyl group, Ac acetyl group, and Me methyl group), etc., the mixture is heated for several hours at the same temperature as above. In this case, it is preferred that the ratio of monomer (B) to monomer (C) used is 50/50 to 0.5/99.5 by mole ratio and the ratio of of monomer (B) to the reaction reagent for introducing unsaturated bond is 2/3 to 2/1 by mole ratio.

The molecular weight of the copolymer having unsaturated bond thus obtained is from about 5,000 to about 500,000.

Then, specific examples of the copolymer having unsaturated bond are illustrated below, but the invention is not limited to these copolymers.

(i)

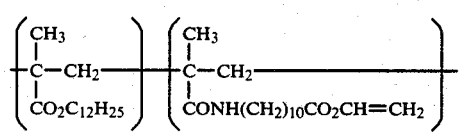

(ii)

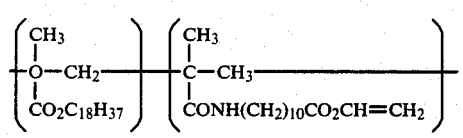

(iii)

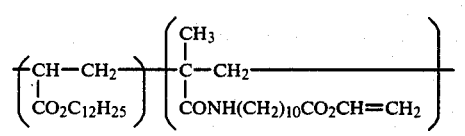

(iv)

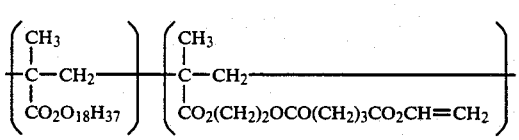

(v)

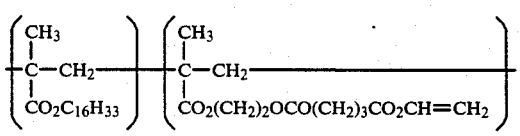

(vi)

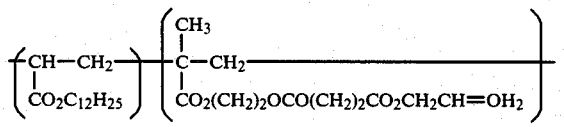

-continued (vii)

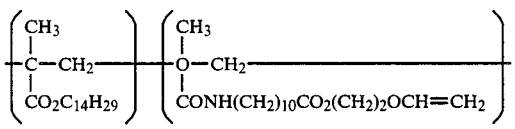

(viii)

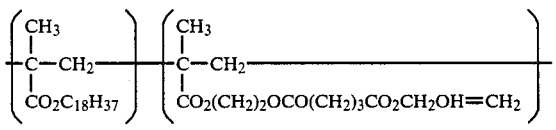

(ix)

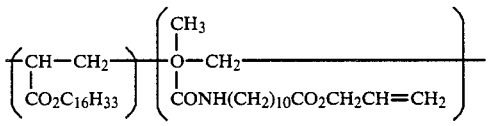

Next, the process of obtaining the dispersion of the granular resin is explained. That is, a mixture of at least one kind of monomer (A) described above and at least one kind of dispersion stabilizing resin containing unsaturated bond obtained by the above-described process is heated together with the aforesaid nonaqueous solvent in the presence of a polymerization initiator to 50° C. to 200° C. for several hours. In this case, a conventional stabilization stabilizer may be used. That is, various kinds of synthetic or natural resins soluble in the nonaqueous solvent employed can be used, singly or as a mixture thereof. Examples of these resins are polymers of monomers such as arylic acid or methacrylic acid alkyl esters having an alkyl chain having 4 to 30 carbon atoms, which may have a substituent such as a halogen atom, a hydroxy group, an amino group, an alkoxy group, etc., or which may have a main chain, carbon-carbon bond by a hetero atom such as an oxygen atom, a nitrogen atom, a sulfur atom, etc.), vinyl esters of fatty acids, vinyl alkyl ethers, or olefins such as butadiene isoprene, diisoprene, etc., copolymers of two or more monomers described above, and copolymers of the various monomers for forming the above-described polymers soluble in the nonaqueous solvent and at least one of the following various monomers, said copolymers being soluble in the nonaqueous solvent. Examples of such a monomer are vinyl acetate; methyl, ethyl, n-propyl or iso-propyl esters of acrylic acid, methacrylic acid or crotonic acid; styrene or styrene derivatives such as vinyltoluene, α-methylstyrene, etc.; unsaturated carboxylic acids such as acrylic acid, methacrylic acid, crotonic acid, maleic acid, itaconic acid, etc., or the anhydrides thereof; and monomers having various polar groups such as a hydroxy group, an amino group, an amido group, a cyano group, a sulfonic acid group, a carbonyl group, a halogen atom, a heterocyclic ring, etc., e.g., hydroxyethyl methacrylate, hydroxyethyl acrylate, diethylaminoethyl methacrylate, N-vinylpyrrolidone, acrylamide, acrylonitrile, 2-chloroethyl methacrylate, 2,2,2-trifluoroethyl methacrylate, etc. In addition to the above-described synthetic resin, an alkyd resin, an alkyd resin modified by various kinds of fatty acids, linseed oil, or a denatured polyurethane resin can be used. In this case, at least one kind of monomer (C) represented by formula (II), which is not solubilized in the aforesaid carrier liquid and nonaqueous solvent even by being polymerized, can be used together with aforesaid monomer (A).

Monomers (A) may be used singly or as a mixture thereof but the total amount thereof is 5 to 80 parts by weight, and preferably from 10 to 50 parts by weight, per 100 parts by weight of the aforesaid nonaqueous solvent which is a reaction solvent. In the case of using monomer (C), the total amount is from 0.1 to 50 parts by weight, and preferably from 0.5 to 20 parts by weight, per 100 parts by weight of the above-described whole monomers (A).

The amount of the dispersion stabilizing resin described above is from 1 to 100 parts by weight, and preferably 5 to 50 parts by weight, per 100 parts by weight of the aforesaid whole monomers (A).

The proportion of the polymerization initiator for use in the aforesaid method is generally from 0.1 to 5 parts by weight per 100 parts by weight of the total monomers.

The nonaqueous dispersion resin prepared by the above process has a uniform and mono-dispersed particle distribution and the particle size thereof can be desirably controlled. These dispersed resins have very good redispersibility, stabilization, and fixability.

Thus, by using the liquid developer composed of the above-described materials, troubles of precipitation, aggregation, sticking stains, etc., on various portions of developing apparatus or vessels do not occur by the storage thereof for a long period of time or by the repeated use thereof, with strong films being formed by performing fixing by heating, etc., and images having high durability are formed. It can be considered that the above-described remarkable improvement of performance is obtained by the following aspects of this invention.

Hitherto, in a conventional resin dispersed in a nonaqueous carrier liquid, there has been a disadvantage that when the liquid developer is stored for a long period of time or is used repeatedly, the soluble dispersion stabilizing resin used is released from the insoluble latex particles, to deteriorate the performance thereof. For eliminating the problems caused thereby, a means as disclosed in U.S. Pat. No. 3,990,980 has been proposed, as described hereinbefore. However, even by the means disclosed in aforesaid U.S. Pat. No. 3,990,980, the improvement of the liquid developer is insufficient and it is considered that the portion of the total soluble dispersion stabilizing resins irreversibly bonded to the insoluble latex particles is very slight. In this invention, however, a remarkable improvement in the performance of the liquid developer is obtained by separating new unsaturated bond introduced into the soluble dispersion stabilizing resin by the reaction for introducing the unsaturated bond from the main chain of the resin to some extent (more than 9 carbon atoms of the main chain moiety of the linkage group) and it is considered to be based on the reduction in steric hindrance at the case of graft polymerizing the aforesaid monomer (A) to the soluble dispersion stabilizing resin.

In this invention, if desired, coloring agents may be used. There is no particular restriction on the coloring agents, and conventional pigments or dyes can be used in this invention. The coloring may be used dispersed in the aforesaid nonaqueous solvent solely or together with a dispersion accelerator, etc., or may be used as graft type particles (e.g., Graft Carbon, trademark for product, made by Mitsubishi Gas Chemical Company, Ltd.) formed by chemically bonding a polymer to the surface of a coloring agent. The coloring agent may be also incorporated in the afresaid resin.

As a method of coloring the aforesaid resin dispersed, one useful method involves physical dispersion in the resin using a dispersing means (e.g., a paint shaker, a colloid mill, a vibration mill, a ball mill, etc.) as described, for example, in Japanese Patent Application (OPI) No. 75242/73, etc. Examples of pigments and dyes which are used for the purpose in this invention are magnetic iron oxide powder, carbon black, nigrosine, alkali blue, Hansa Yellow, Quinacridone Red, Phthalocyanine Blue, Phthalocyanine Black, Benzidine Yellow, etc.

In another method, the colored resin particles can be produced by adding at least one kind of an organic dye directly or as the solution thereof in the dispersion containing the resin particles, and then adding thereto a second solvent which is miscible with the nonaqueous solvent and can at least swell the resin particles, followed by heating.

For example, the resin particles can be dyed using a dye having a solubility in a monomer which is a component for constituting the copolymer sparingly soluble or insoluble in the nonaqueous solvent upon heating. In this case, if desired, the aforesaid second solvent may be present in the system.

In this case, it is considered that the copolymer particles are dyed by impregnating the copolymer particles with a dye used or by adhering the dye to the copolymer particles.

Accordingly, it is preferred to select an optimum dye for dyeing according to the components for constituting the copolymer particles.

Examples of such dyes are disperse dyes such as dyes for dyeing polyester, polyacrylic resins, polyacrylonitrile resins, etc. Specific examples of these dyes are Celliton Fast Yellow RR, Kayalon Fast Yellow G, Kayalon Fast Brown R, Kayalon Fast Scarlet B, Celliton Fast Rubine 3B, Celliton Fast Scarlet R, Kayalon Fast Rubine B, Kayalon Fast Red R, Miketon Fast Pink FR, Kayalon Fast Violet BB, Miketon Fast Violet BB, Kayalon Fast Blue FN, Kayalon Fast Blue Greem B, Sumikaron Yellow FG, Sumikaron Blue BR, Sumikaron Navy Blue R, etc. (with respect to the aforesaid products, Calliton is a trademark for products made by BASF; Kayalon is a trademark for products made by Nippon Kayaku Co., Ltd.; Miketon is a trademark for products made by Mitsui Chemical Co., Ltd.; and Sumikaron is a trademark for products made by Sumitomo Chemical Company, Limited).

Other examples of the dyes are basic dyes. Specific examples of the basic dyes are Flavine 8G, Auramine, Crystal Violet, Methylene Blue, Rhodamine 6G, Malachite Green, Sumiacryl yellow 3G, Sumiacryl Yellow 3R, Sumiacryl Organge G, Sumiacryl Orange R, Aizen Cathilon Pink, Aizen Cathilon Red 6BH, Aizen Basic Cyanine 6GH, Primocyanine BX, etc., (in the above products, Sumiacryl is a trademark for products made by Sumitomo Chemical Company, Limited; and Aizen Cathilon is a trademark for products made by Hodogaya Chemical Co., Ltd.). Furthermore, the dyes described in Masao Iizuka, *Senryo Kogaku* (*Dyeing Industry*), Vol. 13, pp. 429–448(1965) can be used in this invention.

A second solvent which can be used, if desired, capable of dissolving the dye, miscible with the non-aqueous solvent, and capable of at least swelling the resin particles is suitably any monomers used as a component for constituting the resin. The use of such a monomer has advantages in that adverse influences such as the dissolution or aggregation of the resin particles occuring in the case of using other solvents do not occur. However, ethanol, acetone, ethyl acetate, etc., which satisfy the above-described conditions, can be used by carefully controlling the amount thereof.

When a sufficient amount of a monomer residue remains in the case of forming the resin particles by for example, the above-described polymerization granulation method, it is unnecessary to add the second solvent to the dispersion of the resin particles, but when the amount of the monomer residue is small, it is necessary to add the second solvent to the dispersion so that the total amount of the monomer and the second solvent becomes at least one-tenth (1/10th) of the weight of the resin particles in the dispersion.

The second solvent may be added to the resin particle dispersion as a solution of the solvent having dissolved therein a dye, or may be added to the dispersion before or after adding the dye as a powder to the dispersion.

In any case, it is necessary that the dye(s) and the second solvent exist in the resin particle dispersion at the subsequent stage of removing the second solvent from the dispersion. However, the addition of the dye(s) and the second solvent is not always finished before the subsequent state of removing the second solvent and, for example, the dye(s) and/or the second solvent may be supplied to the dispersion while removing the second solvent. Also, the proportion of the second solvent is from about 0.1 to 10 times the weight of the resin particles in the dispersion, but since the solvent is removed under reduced pressure in the subsequent step, it is preferred that the amount of the second solvent is not over $\frac{1}{3}$ of the volume of the resin particle dispersion.

However, the amount of the second solvent is not limited to the aforesaid range, since an optimum addition ratio may exist outside the aforesaid range according to the particular kinds of the dye(s), resin particles, nonaqueous solvent, and second solvent used.

Thus, during or after adding the dye(s) and the second solvent to the dispersion, the removal of the second solvent is performed. The removal of the second solvent is performed by subjecting the dispersion containing the dye(s) and the second solvent to a reduced pressure or by heating the dispersion while subjecting the dispersion to a reduced pressure.

The amount of the dye(s) may be 0.5% by weight or more of the amount of the resin particles in the dispersion, but is preferably 3% by weight or more for obtaining good color density. There is no particular restriction on the maximum amount of the dye(s), but the amount thereof is usually not more than 20% by weight.

The heating temperature for dyeing is usually from 40° C. to 150° C., and preferably from 80° C. to 150° C. Also, the heating time period is from 30 minutes to 12 hours, and preferably from 1 hour to 5 hours.

Mordant dyeing is another method for dyeing the dispersed resin particles. In this method, the dispersed resin particles can be dyed using a basic dye (cationic dye) when at least one component constituting the dispersed resin particles contains an acid group (e.g., carboxy group) or using an acid dye when at least one component constituting the resin particles contains a basic group. This method is based on so-called ionic bonding between the acid group and the basic group.

As the basic dyes for the above-described resin particles composed of the copolymer containing carboxy group, there are Aizen Victoria Blue BH, Aizen Victoria Pure Blue BOH, Aizen Cathilon Grey BLH, Aizen Cathilon Black GH (trademark for product made by Hodogaya Chemical Co., Ltd.), etc., in addition to the above-described basic dyes.

On the other hand, the acid dyes for dyeing the resin particles composed of the copolymer containing a basic group are acid dyes containing carboxy group or a sulfonic acid group and examples of these dyes include Kiton Blue A (trademark for product made by Ciba Corp.), Alizarine Astrol B (trademark for product made by Ikeda Kagaku K.K.), Kayanol Blue N 2G (trademark for product made by Nippon Kayaku Co., Ltd.), Kayacyl Blue BR (trademark for product made by Nippon Kayaku Co., Ltd.), Suminol Fast Sky Blue B (trademark for product made by Sumitomo Chemical Company, Limited), Alizaline Light Brown BL (trademark for made by Mitsubishi Chemical Industries, Ltd.), Aizen Eosine GH (trademark for product made by Hodogaya Kagaku Co., Ltd.), Alizarinol R (trademark for product made by Yamada Kagaku K.K.), etc.

If desired, the carboxy group or the sulfonic acid group of these acid dyes may be converted into the form of a free acid, the form of a metal salt of an organic base, or the form of a quaternary ammonium salt.

The amount of the dye(s) used and the dyeing condition are same as those in the above-described physical dyeing.

These dispersed resin particles have very good redispersibility, stability, and fixability.

The liquid developer of this invention may further contain, if desired, various additives for improving charge characteristics, improving image quality, etc., and practical additives are described, for example, in Yuji Harasaki, *Denshi Shashin* (*Electrophotography*), Vol. 16, No. 2, page 44 (1978).

Specific examples of such additives are di-2-ethylhexylsulfosuccinic acid metal salts, naphthenic acid metal salts, higher resin acid metal salts, lecithin, poly(vinylpyrrolidone), etc.

The amounts of the main components of the liquid developer of this invention are described as follows.

The amount of the insoluble latex particles composed of the resin and the coloring agent as the main components is preferably from about 0.5 to 50 parts by weight per 1,000 parts by weight of the carrier liquid. If the amount is less than 0.5 part by weight, the image density becomes deficient, while if the amount is above 50 parts by weight, fog is liable to form at non-imaged portions. The resin soluble in the carrier liquid such as the above-described dispersion stabilizing agent, etc., is used, if desired, and the amount thereof is preferably from about 0.5 to 100 parts by weight per 1,000 parts by weight of the carrier liquid.

The amount of the charge controlling agent as described above is preferably from about 0.001 to 1.0 part by weight per 1,000 parts by weight of the carrier liquid. Furthermore, the liquid developer may further contain various additives and the upper limit of the total amounts of these additive is regulated by the electric resistance of the liquid developer. That is, if the electric ressistance of the liquid developer in a state of not containing the insoluble latex particles is lower than $10^9$ Ω·cm, images having good continuous gradation is reluctant to obtain and hence the addition amounts of these additives must be controlled in the range of not lowering the electric resistance below $10^9$ Ω·cm.

Some embodiments for producing resins or resin particles for use in this invention are described below, but it should be understood that the scope of this invention is not limited to these embodiments.

PRODUCTION EXAMPLE 1

Production of soluble dispersion stabilizing resin (Compound (i))

A mixed solution composed of 96.7 g of lauryl methacrylate, 5.4 g of monomer B-(1), and 100 g of toluene was heated to 70° C. under nitrogen gas stream and 1.0 g of azobisisobutyronitrile was added thereto with stirring. After 6 hours since then, the mixture was cooled to 40° C. and 0.2 g of hydroquinone was added thereto.

Then, after further adding thereto 6.9 g of vinyl acetate and 0.05 g of mercury acetate, the reaction was performed for 2 hours. The temperature of the mixture was increased again to 70° C., and after further adding thereto $7.5\times10^{-3}$ ml of 100% sulfuric acid, the reaction was performed until the determination value of the carboxylic acid originated in monomer B-(1) was reduced to 50%.

After the reaction was over, 0.04 g of sodium acetate trihydrate was added to the reaction mixture followed by thorough stirring 4,000 g of methanol was added to the reaction mixture to perform reprecipitation and purification, whereby a brownish viscous product was obtained. The mean molecular amount of the viscous product measured by a high-speed liquid chromatograph method was $14.5\times10^4$.

PRODUCTION EXAMPLE 2

Production of soluble dispersion stabilizing resin (Compound (ii))

By following the same procedure as in Example 1, except for using 128.6 g of stearyl methacrylate in place of lauryl methacrylate, a yellowish powder product was obtained. The mean molecular weight measured as in Example 1 was $22.2\times10^4$.

PRODUCTION EXAMPLE 3

Production soluble dispersion stabilizing resin (Compound (iii))

A mixed solution composed of 87.5 g of lauryl acrylate, 9.7 g of monomer B-(1), and 120 g of Isoper E was heated to 80° C. under nitrogen gas stream and the 1.0 g of azobisisobutyronitrile was added thereto while stirring. 3 hours later, 1.0 g of azobisisobutyronitrile was added thereto, and reaction was further conducted for another 3 hours. Then, after adding thereto 0.2 g of hydroquinone, 11.4 g of vinyl acetate and 1.0 g of tetrabutoxy titanium were added to the mixture and then the reaction was performed until the determination value of the carboxylic acid orginated in monomer B-(1) was reduced to 50%. After the reaction was over, the reaction product was reprecipitapted from 4,000 g of acetonitrile, to provide a brownish viscous product. The mean molecular weight of the product was $10.3\times10^4$.

PRODUCTION EXAMPLE 4

Production of soluble dispersion stabilizing resin (Compound (iv))

A mixed solution composed of 137.1 g of stearyl methacrylate, 11.0 g of monomer B-(3), and 300 g of toluene was heated to 70° C. under a nitrogen gas stream, and then 1.5 g of azobisisobutyronitrile was added thereto with stirring. 6 hours later, the mixture was cooled to 40° C. and 0.5 g of hydroquinone was added to the mixture. Then, after further adding thereto 31.0 g of vinyl acetate and 0.2 g of mercury acetate, reaction was performed for another 2 hours. The temperature of the mixture was increased again to 70° C., and after further adding thereto $3.4\times10^2$ ml of 100% sulfuric acid, reaction was performed until the determination value of the carboxylic acid originated in monomer B-(3) was reduced to 35%. After the reaction was over, 0.2 g of sodium acetate trihydrate was added to the reaction mixture followed by stirring well and then, the reaction mixture was reprecipitated and purified as in Production Example 1 to provide a white powder product. The mean molecular weight of the product was $29.5\times10^4$.

PRODUCTION EXAMPLE 5

Production of soluble dispersion stabilizing resin (Compound (v))

A mixed solution composed of 162.0 g of hexadecyl methacrylate, 6.7 g of monomer B-(3), and 200 g of Iospar E was heated to 70° C. under a nitrogen gas stream and then 1.6 g of azobisisobutyronitrile was added thereto while stirring. 6 hours later, 0.2 g of hydroquinone was added to the mixture. Then, the temperature of the mixture was raised to 80° C. and after adding thereto 25.0 g of vinyl acetate and 3 g of tetrabutoxy titanium, the reaction was performed until the determination value of the carboxylic acid originated in the monomer B-(3) was reduced to 50%. After the reaction was over, the reaction product was reprecipitated and purified as in production Example 3, to provide a slightly yellowish viscous product. The mean molecular weight of the product was $28.7\times10^4$.

PRODUCTION EXAMPLE 6

Production of soluble dispersion stabilizing resin (Compound (viii))

A mixed solution composed of 137.1 g of stearyl methacrylate, 11.0 g of monomer B-(3), and 200 g of Isopar G was heated to 80° C. under nitrogen gas stream and then 1.4 g of azobisisobutyronitrile was added thereto with stirring. 6 hours later, 0.1 g of hydroquinone was added to the mixture. Then, after raising the temperature thereof to 110° C., 10.0 g of allyl alcohol and 0.5 g of concentrated sulfuric acid were added to the mixture and the reaction was performed while removing water distilled out in the reaction by Dean-Stark means. The reaction was stopped when the determination value of the carboxylic acid originated in the monomer B-(3) was reduced to 35% and then the reaction mixture was reprecipitated and purified as in Production Example 3, to provide a white powder product. The mean molecular weight was $24.9\times10^4$.

PRODUCTION EXAMPLE 7

Production of soluble dispersion stabilizing resin (Compound (ix))

A mixed solution composed of 105.6 g of hexadecyl acrylate, 64.7 g of monomer B-(1), and 400 g of Isopar G was heated to 80° C. under nitrogen gas stream and then 1.6 g of azobisisobutyronitrile was added to the mixture while stirring. 6 hours later, 0.1 g of hydroquinone was added to the mixture. After raising the temperature of the mixture to 110° C., 58.1 g of allyl alcohol and 0.5 g of concentrated sulfuric acid were added thereto, and then the reaction was performed while removing water distilled out from the mixture by Dean-Stark means. The reaction was stopped when the determination value of the carboxylic acid originated in the monomer B-(1) was reduced to 35% and the reaction mixture was reprecipitated and purified as in Production Example 3 to provide a slightly brownish viscous product. The mean molecular weight of the product was $19.7\times10^4$.

RESIN PARTICLE PRODUCTION EXAMPLE 1

A mixture composed of 13.2 g of the resin obtained by Production Example 1 for soluble dispersion stabilizing resin, 110 g of vinyl acetate, and 440 g of Isoper H was heated to 70° C. under a nitrogen gas stream and then 1.1 g of azobisisovaleronitrile was added to the mixture while stirring. About 40 minutes after the additon of the polymerization initiator, the reaction mixture began to become turbid white and the temperature increased to 85° C. 2 hours later, 0.6 g of azobisisovaleronitrile was further added to the mixture and then reaction was further performed for another 2 hours. After cooling, the reaction mixture was filtered through a cloth of 200 mesh to provide a white dispersion as a latex having a polymerization ratio of 88% and a mean particle size of 0.21 micron.

RESIN PARTICLE PRODUCTION EXAMPLE 2

A mixture composed of 24 g of the resin obtained in Production Example 2 for soluble dispersion stabilizing resin, 120 g of vinyl acetate, and 680 g of isodecane was heated to 70° C. under a nitrogen gas stream, and then 1.2 g of azobisisobutyronitrile was added thereto white stirring. After performing reaction for 6 hours, the reaction mixture was cooled and filtered through a cloth of 200 mesh to provide a white dispersion as a latex having a polymerization ratio of 83% and a mean particle size of 0.16 micron.

RESIN PARTICLE PRODUCTION EXAMPLE 3

A mixture composed of 33.6 g of the resin obtained in Production Example 4 for soluble dispersion stabilizing resin, 240 g of vinyl acetate, and 960 g of Isopar H was added to 70° C. under nitrogen gas stream and then 1.9 g of azobisisovaleronitrile was added to the mixture while stirring. After 2 hours, 0.9 g of azobisisovaleronitrile was further added to the mixture, and then the reaction was further performed for another 4 hours. After cooling, the reaction mixture was filtered through a cloth of 200 mesh to provide a white dispersion as a latex having a polymerization ratio of 85% and a mean particle size of 0.19 micron.

RESIN PARTICLE PRODUCTION EXAMPLE 4

A mixture composed of 60 g of the resin obtained in Production Example 6 for soluble dispersion stabilizing resin, 240 g of vinyl acetate, and 560 g of isodecane was heated to 70° C. under nitrogen gas stream and then 2.4 g of azobisisobutyronitrile was added thereto under stirring. After performing reaction for 7 hours, the reaction mixture thus obtained was cooled and filtered through a cloth of 200 mesh to provide a white dispersion as a latex having a polymerization ratio of 81% and a mean particle size of 0.15 micron.

RESIN PARTICLE PRODUCTION EXAMPLE 5

The same procedure as foregoing Production Example 3 was followed by further adding 7.2 g of crotonic acid to the mixture used in the production example. After cooling, the reaction mixture thus obtained was filtered through a cloth of 200 mesh to provide a white dispersion as a latex having a polymerization ratio of 80% and a mean particle size of 0.15 micron.

RESIN PARTICLE PRODUCTION EXAMPLE 6

The same procedure as foregoing Production Example 4 of resin particles was followed by further adding 7.2 g of crotonic acid to the mixture used in the production example. After cooling, the reaction mixture thus obtained was filtered through a cloth of 200 mesh to provide a white dispersion as a latex having a polymerization ratio of 78% and a mean particle size of 0.12 micron.

RESIN PARTICLE PRODUCTION EXAMPLE 7

A mixture composed of 37.5 g of the resin obtained in Production Example 7 for soluble dispersion stabilizing resin, 125 g of vinyl acetate, 3.7 g of crotonic acid, and 230 g of isodecane was heated to 70° C. under a nitrogen gas stream, and then 1.2 g of azobisisobutyronitrile was added thereto while stirring. 2 hours later, 0.6 g of azobisisobutyronitrile was further added to the mixture and reaction was further performed for 4 hours. After cooling, the reaction mixture thus obtained was filtered through a cloth of 200 mesh to provide a white dispersion as a latex having a polymerization ratio of 79% and a mean particle size of 0.14 micron.

RESIN PARTICLE PRODUCTION EXAMPLE 8

(Comparison Example A)

A mixed solution composed of 194 g of lauryl methacrylate, 6 g of glycidyl methacrylate, and 400 g of isodecane was heated to 80° C. under nitrogen gas stream and then 3.6 g of benzoyl peroxide was added to the mixture under stirring. 4 hours later, 0.1 g of hydroquinone was added thereto, and after adding 0.5 g of lauryldimethylamine and 3 g of methacrylic acid thereto, the reaction was performed until 40% of the glycidyl group formed methacrylic acid and ester. After the reaction was over, the reaction mixture was purified by being reprecipitated from 4,000 g of acetonitrile to provide a slightly brownish viscous product. Then, a mixture composed of 36 g of the aforesaid viscous product, 200 g of vinyl acetate, 6 g of crotonic acid, and 470 g of isodecane was heated to 70° C. under a nitrogen gas stream and then 2 g of azobisisobutyronitrile was added to the mixture while stirring. After performing the reaction for 6 hours, the reaction mixture thus obtained was cooled and filtered through a cloth of 200 mesh to provide a white dispersion as a latex having a polymerization ratio of 78% and a mean particle size of 0.12 micron.

RESIN PARTICLE PRODUCTION EXAMPLE 9

(Comparison Example B)

A mixed solution composed of 124 g of hexadecyl methacrylate, 8.6 g of methacrylic acid, and 350 g of isodecane was heated to 80° C. under a nitrogen gas stream, and then 3.0 g of benzoyl peroxide was added to the mixture under stirring. 4 hours later, 0.1 g of hydroquinone was added thereto and after adding thereto 0.5 g of lauryldimethylamine and 21.3 g of glycidyl methacrylate, reaction was performed until the determination value of the carboxylic acid originated in methacrylic acid was reduced to 20%. After the reaction was over, the reaction mixture was purified by being reprecipitated from 5,000 g of acetonitrile to provide a slightly brownish viscous product.

Then, a mixture composed of 60 g of the viscous product obtained in the above step, 200 g of vinyl acetate, 8.1 g of maleic acid, and 470 g of isodecane was heated to 70° C. under a nitrogen gas stream and then 2 g of azobisisobutyronitrile was added to the mixture while stirring. After performing the reaction for 6 hours, the reaction mixture thus obtained was cooled and filtered through a cloth of 200 mesh to provide a white dispersion as a latex having a polymerization ratio of 75% and a mean particle size of 0.23 micron.

The following examples are intended to illustrate the present invention, but not to limit it in any way.

EXAMPLE 1

In a paint shaker (made by Tokyo Seiki K.K.) 10 g of poly(lauryl methacrylate), 10 g of Nigrosine, and 30 g of Shell Sol 71 were placed together with glass beads, and the mixture was dispersed for 90 minutes to provide a fine dispersion of Nigrosine. Then, by diluting 30 g of the resin dispersion of Resin Particle Production Example 1, 25 g of the Nigrosine dispersion obtained in the above step, and 0.05 g of zirconium naphthenate with one liter of Shell Sol 71, a liquid developer was prepared.

(Comparison Liquid Developers A and B)

Furthermore, by following the same procedure as above except that the following resin particles were used in place of the resin dispersion used in the aforesaid process, two kinds of Comparison Liquid Developers A and B were prepared.

Comparison Liquid Developer A; Using the resin dispersion of Resin Particle Production Example 8.

Comparison Liquid Developer B: Using the resin dispersion by Resin Particle Production Example 9.

Then, by using each of the liquid developers thus obtained as a developer for a Fuji Automatic Electrophotographic Printing Plate-Making Machine ELP 280 (made by Fuji Photo Film Co., Ltd.) and also ELP masters (made by Fuji Photo Film Co., Ltd.) as an electrophotographic light-sensitive material for printing master, images were formed on the ELP master from positive originals having a continuous gradation to provide each master plate. The images of the master plates thus obtained were good. After processing 2,000 ELP masters, the presence of sticking of the toners to the developing device and the presence of contamination were observed.

The results showed that the liquid developer of this invention using the resin particles (prepared by Resin Particle Production Example 1) caused no contamination but two kinds of comparison liquid developers A and B caused great sticking and contamination at the peripheries of rollers. This clearly shows that resin particles obtained by using the resins in which the distance between the main chain and the unsaturated bond in the soluble dispersion stabilizing resins is less than 9 atoms (the number of atoms is 7 in both the comparison examples, niz., Resin Particle Production Examples 8 and 9, respectively) are different from the resin particles in this invention.

In the offset printing master plates obtained using the liquid developer of this invention, the master plate obtained by the first development process as well as the master plate obtained after developing 2,000 masters by the final development process had very clear images. Furthermore, when printing was conducted in an ordinary manner using each of the masters obtained using the liquid developer of this invention, clear prints could be obtained even after printing 3,000 copies. Furthermore, when the same processing as above was performed after allowing the liquid developer to stand for 3 months, the results were exactly the same as those obtained by using the developer before storage.

EXAMPLE 2

A mixture of 100 g of the white dispersion obtained in Resin Particle Production Example 1 and 1.5 g of Sumikaron Black was heated to 100° C. and stirred for 4 hours at the temperature. After cooling the mixture to room temperature, the reaction mixture was filtered through a nylon cloth of 200 mesh to remove the remaining dye, whereby a black resin dispersion having a mean particle size of 0.21 micron was obtained.

Then, by dilusting a mixture of 30 g of the aforesaid black resin dispersion and 0.05 g of zirconium naphthenate with one liter of Shell Sol 71, a liquid developer was obtained.

When, the development was performed by means of the apparatus as in Example 1 using the liquid developer thus obtained, no attachment of toners to the apparatus was observed after developing 2,000 masters.

EXAMPLE 3

A mixture composed of 100 g of the white dispersion obtained in Resin Particle Production Example 3 and 3 g of Victoria Blue B was heated to 70° C. to 80° C. and stirred for 6 hours at the same temperature. After cooling to room temperature, the reaction mixture was filtered through a nylon cloth of 200 mesh to remove the remaining dyes, whereby a blue resin dispersion having a mean particle size of 0.20 micron was obtained.

By diluting a mixture of 28 g of the above-described blue resin dispersion and 0.05 g of zirconium naphthenate with one liter of Isopar H, a liquid developer was prepared.

When the development was performed by means of the apparatus as in Example 1 using the liquid developer prepared above, no sticking of toners to the apparatus was observed even after developing 2,000 masters. The image of the offset printing master plates thus obtained were clear in each case, and the images of the print were very clear even after printing 3,000 copies.

EXAMPLE 4

By diluting a mixture of 30 g of the white resin dispersion obtained in Resin Particle Production Example 2, 2.5 g of the Nigrosine dispersion obtained in Example 1, and 0.02 g of a half docosanylamid product of a copolymer of diisobutylene and maleic anhydride with one liter of Isopar G, a liquid developer was obtained.

When the development was performed by means of the apparatus as in Example 1 using the liquid developer prepared above, no sticking of toners to the apparatus was observed even after developing 2,000 masters. Also, the images of the offset printing master plates thus obtained as well as the images of the print after printing 3,000 copies were clear.

Furthermore, when the liquid developer was allowed to stand for 3 months and then the same processing as above was performed using the developer, the results were exactly the same as those before the storage thereof.

EXAMPLE 5

A mixture composed of 40 g of the white dispersion obtained in Resin Particle Production Example 3, 8 g of Kayalon Fast Blue and 40 g of vinyl acetate was heated to 100° C. and stirred for 2 hours at the same temperature. Thereafter, the reflux condensor was removed and the solvent was distilled off by heating the mixture for 3 hours while stirring. After cooling to room temperature, the reaction mixture thus obtained was filtered through a nylon cloth of 200 mesh to remove the remaining dye, whereby a blue resin dispersion having a mean particle size of 0.20 micron was obtained. Then, by diluting a mixture of 30 g of the aforesaid blue resin dispersion and 0.03 g of a half octadecylamide copolymer of 1-octadecene and maleic acid with one liter of Shell Sol 71, a liquid developer was prepared.

When the development by means of the apparatus as in Example 1 using the liquid developer, no sticking of toners to the apparatus was observed even after developing 2,000 masters.

EXAMPLE 6

A mixture composed of 30 g of the white dispersion obtained in Resin Particle Production Example 5, 1 g of Aizen Basic Cyanine and 3 g of ethanol was heated to 80° C. and stirred for 2 hours at the same temperature. Thereafter, the reflux condensor was removed and the solvent was distilled off by stirring the mixture for 3 hours at the same temperature. After cooling to room temperature, the reaction mixture thus obtained was filtered through a nylon cloth of 200 mesh to remove the remaining dye, whereby a blue resin dispersion having a mean particle size of 0.16 micron was obtained. Then, by diluting a mixture of 30 g of the aforesaid blue resin dispersion and 0.04 g of a copolymer of diisobutylene and half maleic acid octadecylamide with one liter of Shell Sol 71, a liquid developer was obtained.

When the development was performed by means of the apparatus as in Example 1 using the aforesaid liquid developer, no sticking of toners to the apparatus was observed even after developing 2,000 masters. Also, the images of the offset printing master plates thus obtained were clear and the images of the print after printing 3,000 copies were also very clear.

EXAMPLE 7

By following the same procedure as in Example 3 except that 30 g of the white dispersion obtained in Resin Particle Production Example 6 was used in place of 30 g of the white dispersion by Resin Particle Production Example 5 used in Example 3, a liquid developer was prepared.

When the development was performed by means of the apparatus as in Example 1 using the liquid developer thus prepared, no sticking of toners to the apparatus was observed even after developing 2,000 masters. Also, the images of each offset printing master thus obtained and the images of the print after printing 3,000 copies were all clear.

Furthermore, when the same processing as above was performed after allowing the developer to stand for 3 months, the results were exactly the same as those obtained by using the liquid developer before the storage.

EXAMPLE 8

A mixture composed of 50 g of the white dispersion obtained in Resin Particle Production Example 7, 0.3 g of Kayalon Fast Brown, 0.1 g of Miketon Fast Pink, 0.6 g of Victoria Blue, and 10 g of vinyl acetate was heated to 100° C. and stirred for 2 hours at the same temperature. Thereafter, the reflux condenser was removed, and the solvent was distilled off by stirring the mixture for 3 hours at the same temperature. After cooling to room temperature, the reaction mixture thus obtained was filtered through a nylon cloth of 200 mesh to remove the remaining dyes, whereby a black resin dispersion having a mean particle size of 0.15 micron was obtained.

By diluting a mixture of 30 g of the aforesaid black resin dispersion and 0.05 g of zirconium naphthenate with one liter of Shell Sol 71, a liquid developer was prepared.

When the development was performed by means of the apparatus as in Example 1 using the liquid developer thus prepared, no sticking of toners to the apparatus was observed even after developing 2,000 master plates. Also, the images of each offset printing master plate and the images of the print after printing 3,000 copies were all very clear.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising a carrier liquid having an electric resistance of at least $10^9$ Ω·cm and a dielectric constant of not more than 3.5, and a resin dispersed therein, said resin being obtained by polymerizing a monomer, which is soluble in said carrier liquid but becomes insoluble upon being polymerized, in the presence of at least one kind of a soluble dispersion stabilizing resin, said soluble dispersion stabilizing resin being a copolymer containing at least recurring units represented by following formulae (IIIa) and (IIIb) obtained by applying a reaction for introducing an unsaturated bond into a copolymer obtained by polymerizing a monomer represented by formula (I) and a monomer represented by formula (II)

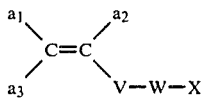
(I)

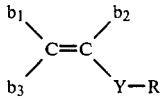
(II)

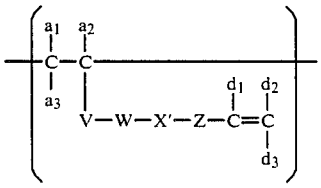
(IIIa)

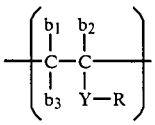
(IIIb)

wherein in formula (I), V represents —O—, —S—, —CO—, —$CO_2$—, —$SO_2$—, —OCO—, —CONH—, —CONR′— (wherein R′ represents a hydrocarbon group), —NHCO—, $NHCO_2$—, or —NHCONH—; X represents —$CO_2H$, —COCl, —OH, —SH, —$NH_2$, —NCO, or —$SO_2CH_2CH_2Cl$; W represents a hydrocarbon group linking said atomic group V and said atomic group X directly or through a hetero atom or W represents a chemical bond; and $a_1$, $a_2$, and $a_3$ each represents a hydrogen atom, a hydrocarbon group, a carboxy group, or a carboxy group through a hydrocarbon group;

in formula (II), Y represents —O—, —S—, —CO—, —$CO_2$—, —$SO_2$—, —OCO—, CONH—, —CONR″— (wherein R″ represents a hydrocarbon group), —NHCO—, —$NHCO_2$—, or —NHCONH—; R represents a hydrocarbon group; and $b_1$, $b_2$, and $b_3$ each represents a hydrogen atom, a hydrocarbon group, a carboxy group, or a carboxy group through a hydrocarbon group;

in formula (IIIa), $a_1$, $a_2$, $a_3$, V, and W have the same meanings as defined for formula (I); X′ represents —$CO_2$—, —COS—, —SCO—, —CONH—, —OCO—, —NHCO—, —NHCONH—, —$SO_2$—, —O—, or —S—; Z represents a hydrocarbon group linking said atomic group X′ and unsaturated bond directly or through a hetero atom, or Z represents a chemical bond; the total number of atoms of the main chain portion of atomic group —V—W—X′—Z— must, however, be at least 9; and $d_1$, $d_2$, and $d_3$ each represents a hydrogen atom, a hydrocarbon group, a carboxy group, or a carboxy group through a hydrocarbon group; and in formula (IIIb), $b_1$, $b_2$, $b_3$, Y, and R have the same meanings as defined for formula (II).

2. A liquid developer for electrostatic photography comprising a carrier liquid having an electric resistance of at least $10^9$ Ω·cm and a dielectric constant of not more than 3.5 and a colored resin dispersed therein, said colored resin being a colored copolymer resin obtained by the following procedure (1) and (2):

(1) a resin dispersion is prepared by polymerizing a monomer, which is soluble in said carrier solvent but becomes insoluble upon being polymerized, in the presence of a copolymer, as a soluble dispersion stabilizing resin, containing at least recurring units represented by formulae (IIIa) and (IIIb) obtained by applying a reaction for introducing an unsaturated bond into a copolymer obtained by polymerizing a monomer represented by formula (I) and a monomer represented by formula (II);

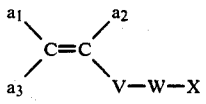

(I)

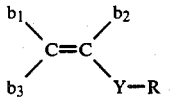

(II)

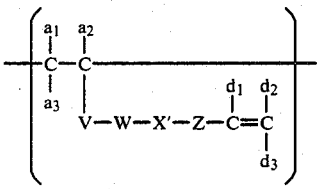

(IIIa)

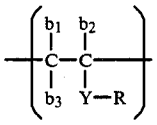

(IIIb)

wherein in formula (I), V represents —O—, —S—, —CO—, —$CO_2$—, —$SO_2$—, —OCO—, —CONH—, —CONR′— (wherein R′ represents a hydrocarbon group), —NHCO—, $NHCO_2$—, or —NH-CONH—; X represents —$CO_2H$, —COCl, —OH, —SH, —$NH_2$, —NCO, or —$SO_2CH_2CH_2Cl$; W represents a hydrocarbon group linking said atomic group V and said atomic group X directly or through a hetero atom or W represents a chemical bond; and $a_1$, $a_2$, and $a_3$ each represents a hydrogen atom, a hydrocarbon group, a carboxy group, or a carboxy group through a hydrocarbon group;

in formula (II), Y represents —O—, —S—, —CO—, —$CO_2$—, —$SO_2$—, —OCO—, —CONH—, —CONR″— (wherein, R″ represents a hydrocarbon group), —NHCO—, $NHCO_2$—, or —NH-CONH—; R represents a hydrocarbon group; and $b_1$, $b_2$, and $b_3$ each represents a hydrogen atom, a hydrocarbon group, a carboxy group or a carboxy group through a hydrocarbon group;

in formula (IIIa), $a_1$, $a_2$, $a_3$, V and W have the same meanings as defined for formula (I); X′ represents —$CO_2$—, —COS—, —SCO—, —CONH—, —OCO—, —NHCO—, —NHCONH—, —$SO_2$—, —O— or —S—; Z represents a hydrocarbon group linking said atomic group X′ and unsaturated bond directly or through a hetero atom, or Z represents a chemical bond; the total number of atoms of the main chain portion of atomic group —V—W—X-′—Z— must, however, be at least 9; and $d_1$, $d_2$, and $d_3$ each represents a hydrogen atom, a hydrocarbon group, a carboxy group, or a carboxy group through a hydrocarbon group; and in formula (IIIb), $b_1$, $b_2$, $b_3$, Y and R have the same meanings as defined for formula (II);

(2) the colored copolymer resin is produced by adding at least one kind of an organic dye into the resin dispersion obtained in above-described method (1) and heating the mixture.

3. The liquid developer as claimed in claim 1, wherein the monomer, which is soluble in the carrier liquid but becomes insoluble upon being polymerized, is a substance represented by the following formula (IV), itaconic anhydride, maleic anhydride, vinylpyrrolidone, and acrylonitrile.

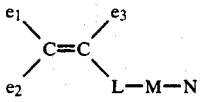

(IV)

wherein $e_1$, $e_2$ and $e_3$ each represents a hydrogen atom, a hydrocarbon group having 1 to 4 carbon atoms, a carboxy group, or a carboxy group through a hydrocarbon group; L represents a hydrocarbon atom having 1 to 2 carbon atoms, or L represents a chemical bond; M represents —$CO_2$—, —OCO—, or —O—; and N represents a hydrogen atom, a hydrocarbon group having 1 to 3 carbon atoms, or a hydroxyl group through a hydrocarbon group.

4. The liquid developer as in claim 1, wherein the carrier liquid is an unsubstituted or halogen-substituted straight-chain or branched-chain aliphatic hydrocarbon.

5. The liquid developer as in claim 2, wherein the carrier liquid is an unsubstituted or halogen-substituted straight-chain or branched-chain aliphatic hydrocarbon.

6. The liquid developer as in claim 2, wherein the heating is conducted at a temperature of from 40° C. to 150° C. for a period of from 30 minutes to 12 hours.

7. The liquid developer as in claim 2, wherein the heating is conducted at a temperature of from 80° C. to 150° C. for a period of from 1 hour to 5 hours.

8. The liquid developer as in claim 2, wherein the amount of dye is 3% by weight or more with respect to the weight of the resin particles in the dispersion.

9. The liquid developer as claimed in claim 2, wherein an organic solvent capable of swelling the monomer or resin is used in the procedure (1).

10. The liquid developer as claimed in claim 9, wherein the organic solvent is used in an amount of about 0.1 to 10 times the weight of the resin particles in the dispersion.

* * * * *